United States Patent [19]

Miura

[11] Patent Number: 4,493,265

[45] Date of Patent: Jan. 15, 1985

[54] ELECTRIC RERAILER FOR A MODEL RAILWAY

[76] Inventor: Fukushiro Miura, 15-2 Moegino, Midori-ku, Yokohama-shi, Kanagawa-ken, Japan

[21] Appl. No.: 390,673

[22] Filed: Jun. 21, 1982

[30] Foreign Application Priority Data

Dec. 29, 1980 [JP] Japan ..... 55/185419

[51] Int. Cl.[3] ..... B61K 5/06; A63H 18/12

[52] U.S. Cl. ..... 104;269; 104/262; 238/10

[58] Field of Search ..... 46/1 K, 216, 257, 260; 104/54, 262, 264, 265, 268, 269, 270, 274, 288, 295; 238/14.3, 14.13, 152

[56] References Cited

U.S. PATENT DOCUMENTS

| | | | |
|---|---|---|---|
| D. 34,906 | 8/1901 | Johnson | 104/262 X |
| 1,821,880 | 9/1931 | Connick | 104/262 |
| 2,451,042 | 10/1948 | Nancarrow et al. | 104/262 |
| 2,530,895 | 11/1950 | Melior | 104/264 |
| 2,590,317 | 3/1952 | Henderson | 104/264 |
| 2,647,468 | 8/1953 | Saunders | 104/264 |
| 3,986,717 | 10/1976 | Kirby et al. | 46/1 K X |
| 4,185,409 | 1/1980 | Cheng | 46/1 K |

FOREIGN PATENT DOCUMENTS

| | | | |
|---|---|---|---|
| 821324 | 11/1951 | Fed. Rep. of Germany | 104/262 |
| 684133 | 12/1952 | United Kingdom | 104/262 |
| 689656 | 4/1953 | United Kingdom | 104/264 |

*Primary Examiner*—Randolph Reese
*Assistant Examiner*—David F. Hubbuch
*Attorney, Agent, or Firm*—Saidman, Sterne, Kessler & Goldstein

[57] ABSTRACT

An electric rerailer provided with guide ways for guiding a motor-driven vehicle of a model railway onto a pair of rails, in which the surfaces of the guide ways are formed by electric conductors electrically isolated from each other and used respectively for the left and right wheels of the vehicle, and the conductors are capable of being electrically contacted with the rails for the left and right wheels respectively. The guide ways are formed on inclined or horizontal surfaces of the rerailer base, and the rerailer base is capable of being releasably mounted on the rails or being connected between ends of the rails.

8 Claims, 21 Drawing Figures

ELECTRIC RERAILER FOR A MODEL RAILWAY

BACKGROUND OF THE INVENTION

1. Field of the Invention

This invention relates generally to a rerailer for a model railway, and more particularly to a rerailer for a power-driven vehicle such as locomotive, motive power car or the like.

2. Description of the Prior Art

When a model railway is used, it sometimes happens that the wheels of a model railway vehicle cannot easily be placed on the rails since the wheels under the vehicle body cannot be seen easily. To prevent this, a rerailer is used as a guide member for guiding a vehicle onto the rails. A conventional rerailer is constructed in the form of an inclined base having a wide wheel guide groove on its inclined surface. The width of the guide groove is narrowed at the lower section of the inclined surface so as to guide the wheels on both sides of the vehicle onto the rails. When the rerailer is placed on the rails and a vehicle is placed on the inclined surface of the rerailer, the vehicle moves on the inclined surface under its own weight and the wheels are guided by the guide groove onto the rails.

The conventional rerailer as described above is useful for guiding carriages, wagons, passenger cars, freight cars, etc., because they can freely move on the inclined surface of the rerailer under their own weight. However, motor or power-driven vehicles such as locomotives and motive power cars cannot move on the inclined surface under their own weight because their motors and speed reducing mechanism serve as brakes. Therefore, the power-driven vehicles must be guided onto the rails by manually moving them.

SUMMARY OF THE INVENTION

The primary object of the present invention is to provide an improved rerailer for a model railway.

Another object of the present invention is to provide a rerailer for automatically guiding a power-driven vehicle onto the rails.

The specific object of the present invention is to provide an electric rerailer capable of supplying a drive current to a power-driven vehicle placed on the rerailer, and electrically moving the vehicle onto the rails.

The rerailer in accordance with the present invention is characterized in that the surfaces of guide rails for guiding a vehicle onto the rails are formed by discrete electric conductors used respectively for the left and right wheels of the vehicle, and the conductors are electrically contacted with the rails for the left and right wheels, respectively. The conductors forming the surfaces of the guide rails (note that various types of guide paths such as groove-like paths, plane-like paths with a central partition wall and the like are herein called guide rails) transmit a drive current to the vehicle via the outermost circumference of wheels (large diameter sections) so as to move the vehicle on the rerailer and guide it onto the rails.

The electric rerailer in accordance with the present invention has an extremely simple construction suitable to guide a power-driven vehicle.

The rerailer in accordance with the present invention can be used to automatically move a power-driven vehicle onto the rails, and can of course be used also for guiding vehicles such as carriages which are not power driven. The rerailer may take an inclined form or a horizontal plane form. When it is horizontal, the vehicle being rerailed can easily be moved onto the rails through the use of electric power or by slightly pushing the vehicle forward onto the rails.

DESCRIPTION OF THE PREFERRED EMBODIMENTS

The present invention will be described in further detail with reference to the accompanying drawings.

Figure 1:
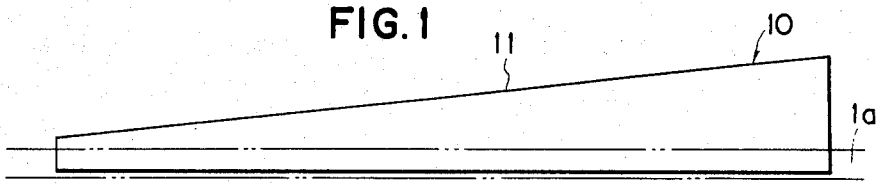
FIG. 1 is a side view showing an embodiment of the electric rerailer in accordance with the present invention.
Figure 2:
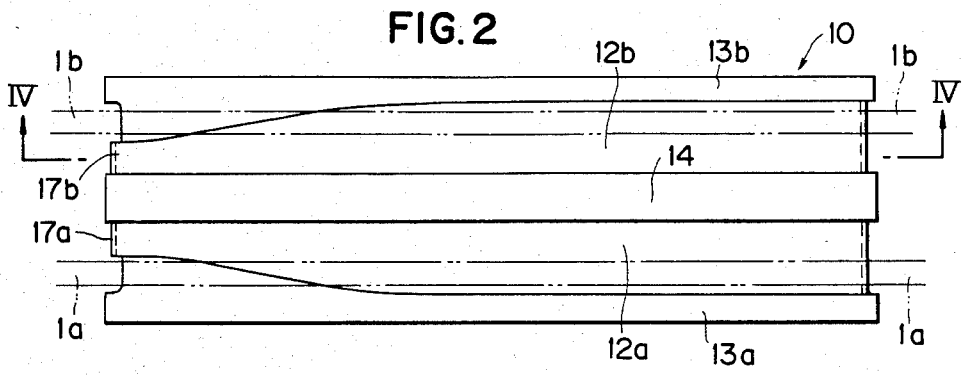
FIG. 2 is a top plan view showing the embodiment of FIG. 1.
Figure 3:
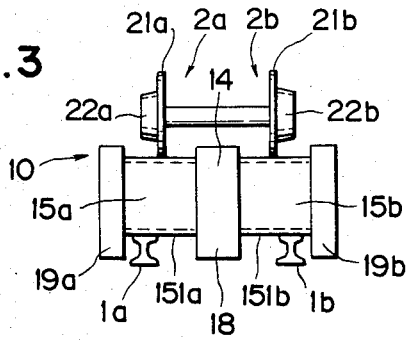
FIG. 3 is an end view, viewed from the right of FIG. 1.

FIGS. 1 to 4 show an embodiment of the inclined base type rerailer capable of being releasably mounted on a pair of rails in accordance with the present invention. As shown in FIGS. 1 to 4, a rerailer 10 is placed on a pair of rails 1*a* and 1*b* of a model railway, and is provided with guide rails 12*a* and 12*b* for guiding the left and right wheels 2*a*, 2*b* respectively of a vehicle (as viewed from the upper end of a rerailer 10: the right side of FIGS. 1, 2 and 4) on an inclined surface 11. The guide rails 12*a* and 12*b* are in the form of shallow grooves, the outer edges of which are defined by guide walls 13*a* and 13*b*. The guide walls 13*a* and 13*b* protrude inwardly at the lower section of the inclined surface 11 so as to guide the wheels 2*a* and 2*b* onto the rails 1*a* and 1*b*. Namely, the guide walls 13*a* and 13*b* guide the large diameter sections (flanges) 21*a* and 21*b* of wheels 2*a* and 2*b*, as shown in FIG. 3, inwardly towards the middle between the guide walls 13*a* and 13*b* so as to place the small diameter sections 22*a* and 22*b* of the wheels 2*a* and 2*b* onto the rails 1*a* and 1*b*.

Figure 4:
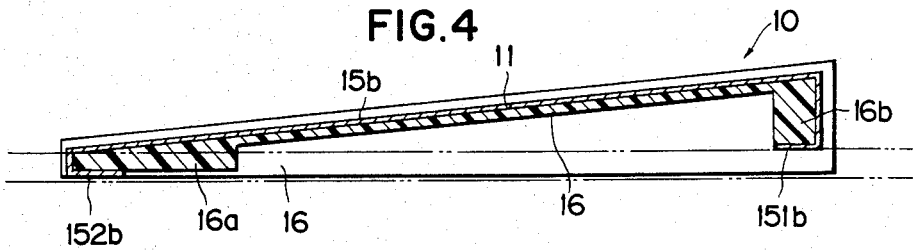
FIG. 4 is a sectional view taken along the line IV—IV of FIG. 2, FIGS. 5A, 5B, 5C and 5D are top plan views showing various modifications of the embodiment shown in FIG. 1, FIGS. 6A and 6B are a perspective view and a transverse sectional view, respectively, showing another embodiment of the electric rerailer in accordance with the present invention.

Between the guide rails 12*a* and 12*b* is positioned a central guide wall 14, which prevents the vehicle from greatly deviating towards the guide wall 13*a* or 13*b* and which serves as a central partition for physically and electrically separating the guide rails 12*a* and 12*b* from each other. The surfaces of the guide rails 12*a* and 12*b* are formed by electric conductors. In the embodiment shown, the surfaces of guide rails 12*a* and 12*b* are formed by plate-like metal strips 15*a* and 15*b*, which are fitted by their elasticity to a plastic rerailer base 16 having the inclined surface 11, as best seen in FIG. 4. As shown in FIG. 4, a turned-back end 152*b* of the metal strip 15*b* is fixed by its elasticity to a lower thick-wall section 16*a* of the rerailer base 16, and the other turned-back end 151*b* of the metal strip 15*b* is fixed by its elasticity to an upper thick-wall section 16*b* of the rerailer base 16. The metal strip 15*a* is similarly constructed to have a turned-back ends 152*a* and 151*a* (see FIG. 3).

The plate-like metal strip conductors 15*a* and 15*b* (FIGS. 3 and 4) forming the surfaces of the guide rails 12*a* and 12*b* are electrically isolated from each other. Further, when the rerailer 10 is placed on the rails 1*a* and 1*b*, the turned-back ends 151*a* and 151*b* of these conductors 15*a* and 15*b* contact the rails 1*a* and 1*b* respectively. In this way, electric power is provided by rails 1*a* and 1*b* to conductors 15*a* and 15*b*, respectively.

The rerailer 10 is provided with a positioning means for properly positioning the rerailer body on the rails in such a way that wheel guide outlets 17*a* and 17*b* at the lower end of the rerailer 10 (FIG. 2) are positioned just inside the rails 1*a* and 1*b* respectively so as to guide the wheels 2*a* and 2*b* onto the rails 1*a* 1*b*. The positioning means, for example, may comprise recesses which are formed at the bottom of the rerailer body so as to fit snugly on the rails 1*a* and 1*b*. Or, as shown in FIG. 3, sections 18, 19*a* and 19*b* may be protruded downwardly from the rerailer body at the center and on both sides thereof, and the recesses formed among them may be placed on the rails 1*a* and 1*b*. In any case, the metal strip conductors 15*a* and 15*b* should contact the rails 1*a* and 1*b*, respectively.

In the embodiment shown, the metal strips 15*a* and 15*b* forming the surfaces of the guide rails 12*a* and 12*b* are turned back at both ends and fitted by their own elasticity to the rerailer base. This fitting method is advantageous for simplifying the construction and process for assembling the rerailer. However, the metal strips 15*a* and 15*b* may be of any other form insofar as they can be fixed to the rerailer base and parts of them contact with the rails. In short, the metal strips 15*a* and 15*b* may be of any construction having flat sections forming the surfaces of the guide rails 12*a* and 12*b* and the sections for electrically connecting the flat sections to the rails 1*a* and 1*b*, respectively.

Figure 5A:
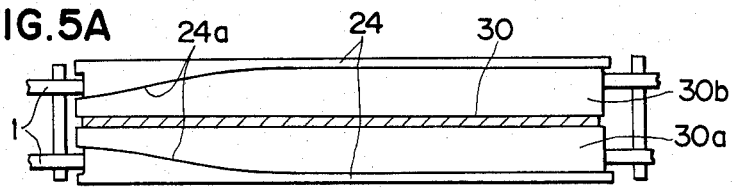
Figure 5B:
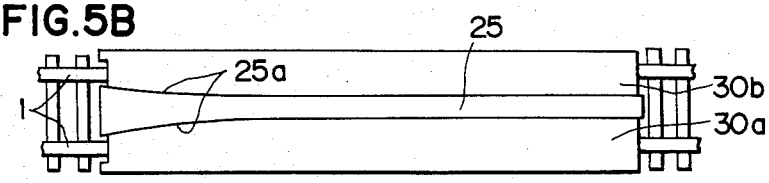

Further, in the embodiment described above, the guide rails 12*a* and 12*b* are provided with the central guide wall 14 for separating them and with the outer guide walls 13*a* and 13*b*. However, this construction may be modified in various ways. For example, as shown in FIG. 5A, it is possible to provide only outer walls 24 as the guide walls and to have these gradually protrude towards the center therebetween at the outlet side of the rerailer so as to form guide wall sections 24*a* for guiding the wheels from the outside thereof onto the rails 1. Conversely, as shown in FIG. 5B, it is possible to provide only an inner wall 25 as the guide wall and to have this gradually widened at the outlet side of the rerailer so as to form a guide wall section 25*a* for guiding the wheels from the inside thereof onto the rails 1.

Figure 5C:
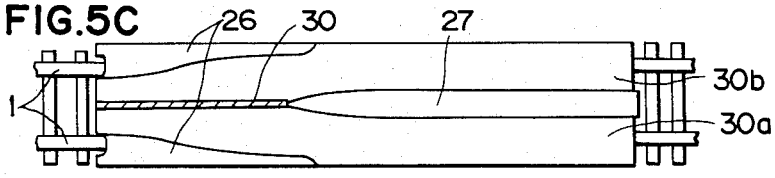
Figure 5D:
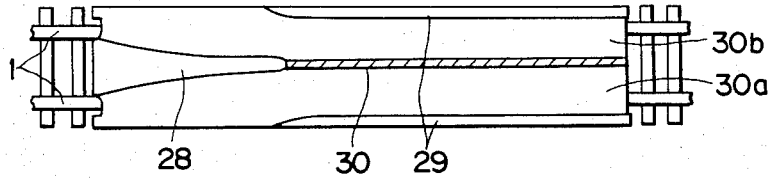

Further, as shown in FIG. 5C, outer walls 26 may be provided on the outlet side of the rerailer, and an inner wall 27 may be provided on the inlet side of the rerailer. As shown in FIG. 5D, it is also possible to form only an inner wall 28 on the outlet side of the rerailer, and outer walls 29 on the inlet side of the rerailer. Note that in FIGS. 5A, 5C and 5D, conductors 30*a* and 30*b* are electrically isolated from each other by an electric insulating section 30. The electric insulating section 30, for example, may be formed by an insulator or a gap positioned between the conductors 30*a* and 30*b*.

In the above-described embodiments, the rerailer has an inclined surface and is placed on the rails. However, the rerailer may have a horizontal surface instead of the inclined surface. In this case, a rerailer having two horizontal guide rails is placed on the rails 1*a*, 1*b* of a model railway. The horizontal surfaces on which the wheels of a vehicle are guided are formed by conductors, and the conductors are electrically contacted with the rails. Outlets for the vehicle may be formed on both ends of the rerailer to allow a power-driven vehicle to be driven forwards or backwards and guided onto rails.

Figure 6A:
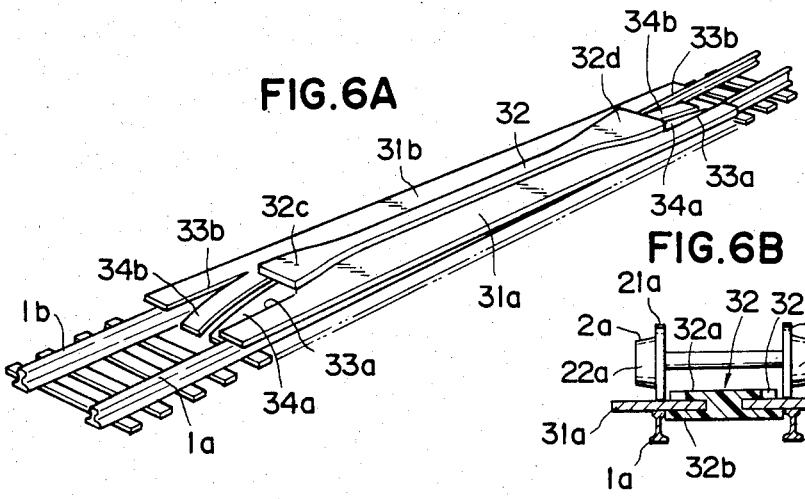
Figure 6B:
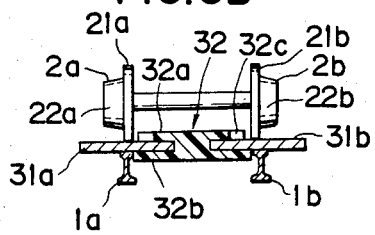

FIGS. 6A and 6B show just such an embodiment of the rerailer in accordance with the present invention, which has a horizontal surface and is placed on rails 1*a*, 1*b*. This embodiment is characterized by an extremely simplified construction in which the rerailer body is formed by the conductors themselves. As shown in FIGS. 6A and 6B, a pair of flat conductor plates 31*a* and 31*b*, which serve as the guide rails, are sandwiched and fixed between an upper plate 32*a* and a lower plate 32*b* of an I-shaped insulating plastic holder 32, which also serves as a central partition wall. The central partition wall 32 has wide end sections 32*c* and 32*d*, whose ends associated with rails 1*a* and 1*b* are widened to a width approximately equal to the inside width between the rails 1*a* and 1*b*. The conductor plates 31*a* and 31*b* are respectively provided with longitudinal slits 33*a* and 33*b* at both ends. Inner portions 34*a* and 34*b* of the conductor plates 31*a* and 31*b*, which define the slits 33*a* and 33*b* are bent downwardly inside the rails 1*a* and 1*b*, so that the large diameter sections 21*a* and 21*b* of wheels 2*a* and 2*b* can move downwardly and small diameter sections 22*a* 22*b* can be smoothly placed onto the rails 1*a* and 1*b*.

The embodiment shown in FIGS. 6A and 6B is very convenient from a practical viewpoint because it has a simple construction and because power-driven vehicles can be moved either forwards or backwards to be placed on the rails 1*a* 1*b*.

Note that in the embodiment shown in FIGS. 6A and 6B, the insulating plastic holder 32 may take various shapes instead of the I-shaped sectional form that is shown. It is also possible to position the conductor plates 31*a*, 31*b* on a plastic plate in parallel spaced from each other, and to fix them to such plastic plate with screws or other fastening means.

In the various embodiments shown in FIGS. 1 to 6B, the rerailer is placed on the rails when it is used, and removed therefrom after a vehicle has been guided and moved onto the rails. When the rerailer is used, it is first placed on the rails, and the conductors of the rerailer are electrically connected to the rails due to the physical contact of the rerailer with the rails. Thereafter, a power-driven vehicle is placed on the guide rails of the rerailer in such a manner that the wheels on one side of the vehicle are placed on one conductor and the wheels on the other side are placed on the other conductor. The rails are then energized in the same way as normally used for starting the power-driven vehicle by use of a controller. An electric current is fed from the rail to the conductor and then to the large diameter section of the wheel to the drive motor in the vehicle to start the vehicle. The started motor-driven vehicle is guided along the outer walls or the inner wall onto the rails and thereafter runs on the rails in the usual manner. In this way, the motor-driven vehicle is guided onto the rails 1*a*, 1*b* by the rerailer 10 in accordance with the present invention.

Figure 7:
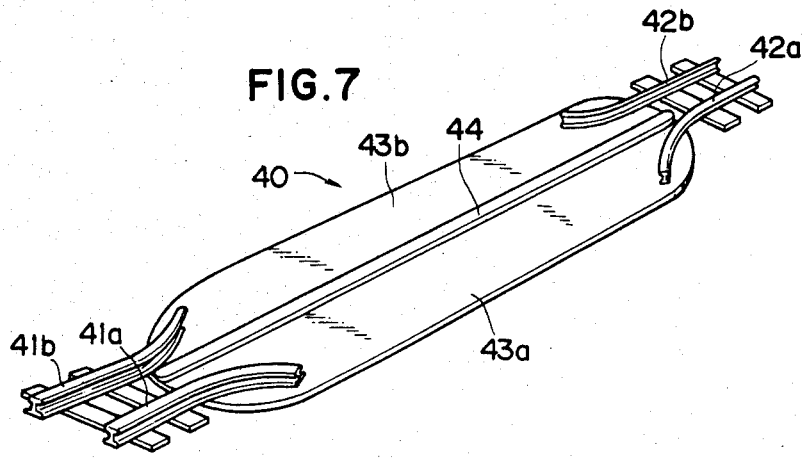
FIGS. 7 and 8 are perspective view and a transverse sectional view, respectively, showing a further embodiment of the electric rerailer in accordance with the present invention.
Figure 8:
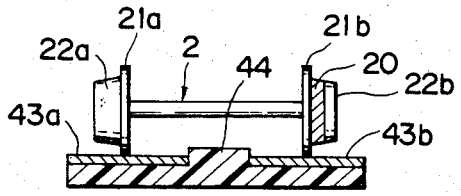

FIGS. 7 and 8 show a further embodiment of the rerailer in accordance with the present invention, which is of the type incorporated between the rails as opposed to being placed on top of the rails. In this embodiment, a rerailer 40 comprises conductor guide plates 43*a*, 43*b* having connection rails 41*a*, 41*b* and 42*a*, 42*b* at opposite ends, and a guide wall 44 serving as a physical and electrical partition provided at the center of the conductor guide plates 43*a*, 43*b*. The connection rails 41*a* and 42*a* for the left wheels (or right wheels, depending on the direction in which the vehicle faces) are electrically connected to a conductor guide plate 43*a* for the left (right) wheels. The connection rails 41*b* and 42*b* for the right (left) wheels are electrically connected to a conductor guide plate 43*b* for the right (left) wheels. The guide plates 43*a* and 43*b* made of conductors are electrically isolated from each other by the guide wall 44. As shown in FIG. 8, the large diameter sections 21*a* and 21*b* of wheels indicated generally by reference numeral 2 electrically contact the surfaces of the conductor guide plates 43*a* and 43*b*, respectively, while the small diameter sections 22*a* and 22*b* and a slip-proof vinyl ring 20 do not. In the embodiment shown, the guide wall 44 serving as the central partition works in the same way as the inner wall 27 in FIG. 5C, and the ends of the rails 41*a*, 41*b*, 42*a* and 42*b* on the guide plate side are flared outwardly so as to work in the same way as the outer walls 26 in FIG. 5C. However, this construction may be varied in various ways.

Figure 9A:
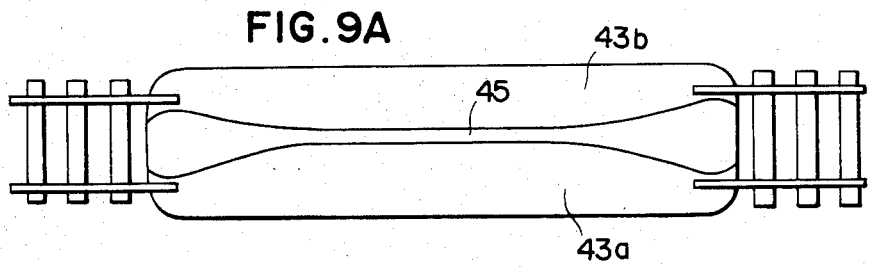
FIGS. 9A to 9C are top plan views showing various modifications of the embodiment shown in FIG. 7.
Figure 9B:
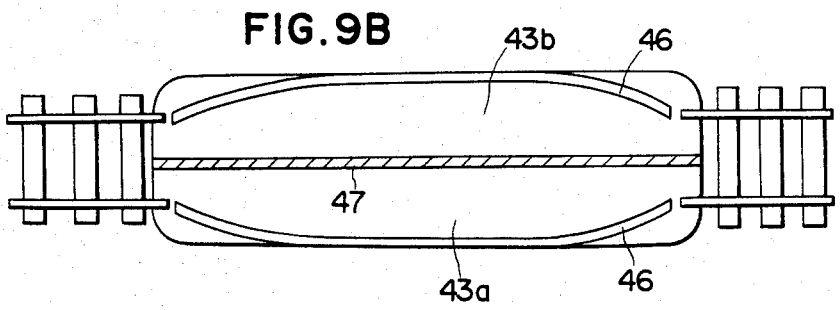

For example, as shown in FIG. 9A, the connection rails may be straight and a central guide wall 45 may be widened at both ends adjacent to the connection rails. Alternatively, as shown in FIG. 9B, the connection rails may be straight, and outer walls 46 may be bent inwardly at both ends adjacent to the connection rails. In the latter case, a central insulator or partition 47 is necessary for electrically isolating conductors 43*a* and 43*b* from each other.

Figure 9C:
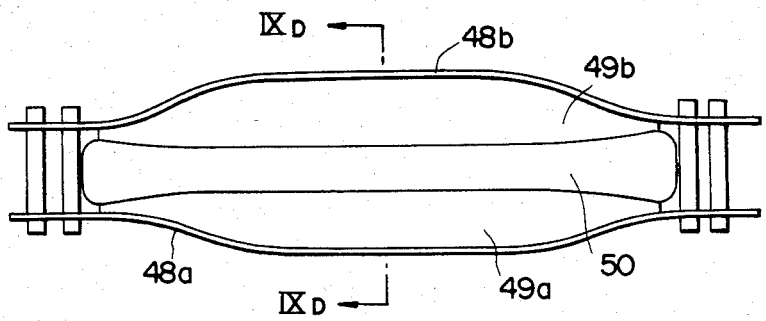
Figure 9D:
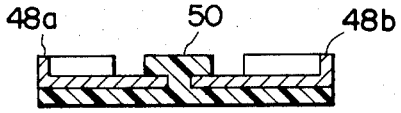
FIG. 9D is a sectional view taken along the line $IX_D$—$IX_D$ of FIG. 9C.
Figure 10A:
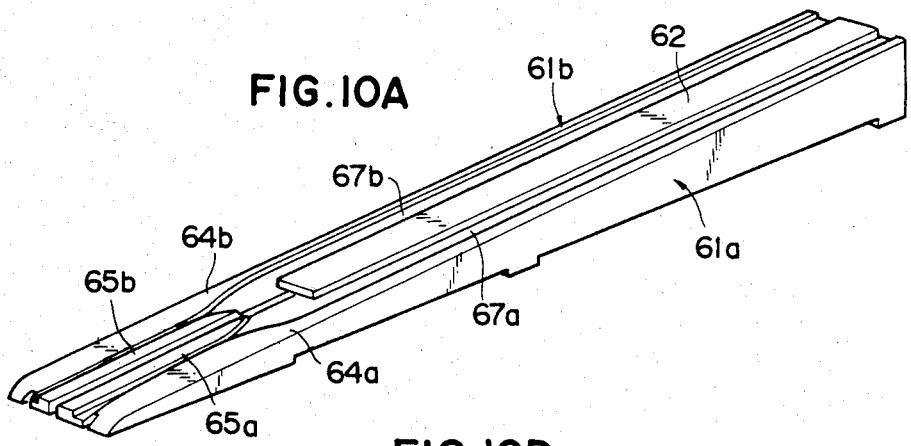
FIG. 10A is a perspective view showing another embodiment of the electric rerailer in accordance with the present invention.
Figure 10B:
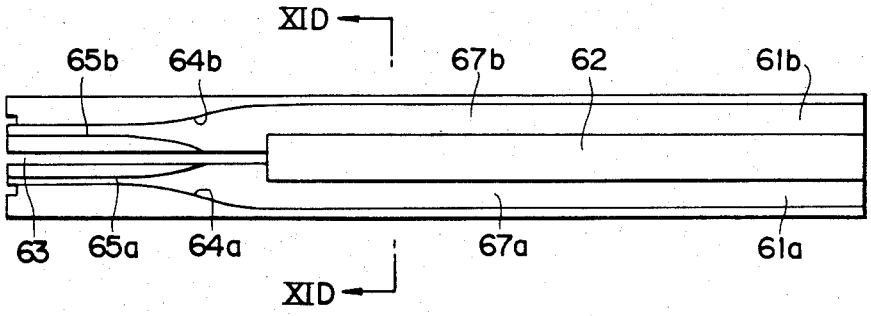
FIG. 10B is a top plan view showing the embodiment of FIG. 10A.
Figure 10C:
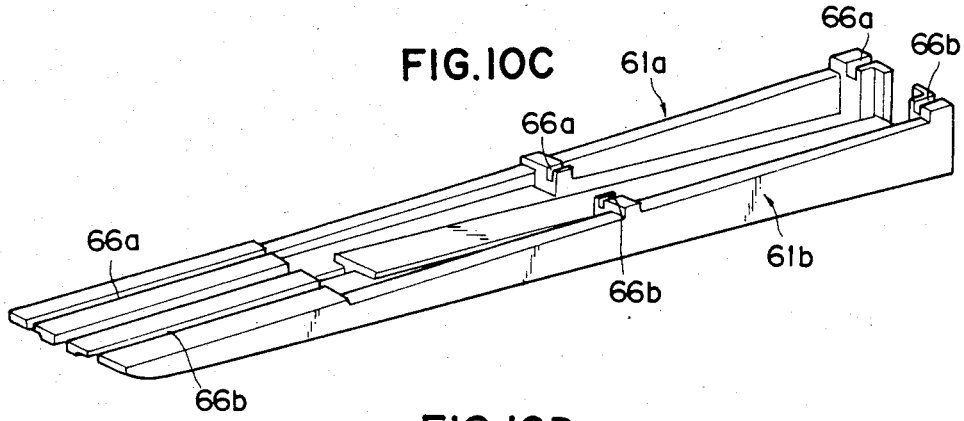
FIG. 10C is a perspective view showing the bottom of the embodiment shown in FIG. 10A.
Figure 10D:
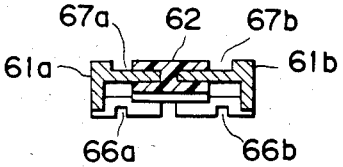
FIG. 10D is a sectional view taken along the line $XI_D$—$XI_D$ of FIG. 10B.

It is not necessary for the insulator or partition 47 to be provided between the conductors 43*a*, 43*b* over their full length. Thus, for example, the conductors may be separated at their intermediate portions by a clearance therebetween and be spaced apart and fixed to each other in the vicinity of both ends. Further, as shown in FIGS. 9C and 9D, the rails may be integrally connected with the outer walls to form rails 48*a* and 48*b* serving as guide walls fixed to the outer edges of conductor plates 49*a* and 49*b*, respectively, and a central guide wall 50 may be positioned between the conductor plates 49*a* and 49*b*. This construction is identical with that in which the outer walls 46 in FIG. 9B are integrally connected with the rails and the central guide wall in FIG. 7 or 9A is positioned therebetween. In FIG. 9C, the central guide wall 50 may of course be replaced by a clearance between the conductor plates 49*a* and 49*b*.

In embodiment where the guide rails of the rerailer are provided with either the outer walls or the inner wall, it is of course necessary to determine the width of the conductor of each guide rail so that the wheels on one side cannot go onto the conductor for the wheels on the other side or fall off the conductor. Thus, when only the outer walls are formed, the width of each conductor must always be smaller than the distance between the large diameter sections 21*a* and 21*b* of the wheels. When only the inner wall is formed, the distance from the outer edge of one conductor to the inner edge of the other conductor must always be larger than the distance between the large diameter sections 21*a* and 21*b* of the wheels.

The embodiments shown in FIGS. 7 to 9C having rails for connecting with the track of a model railway at both ends are extremely useful in practical use because the rerailer can be connected to the track at any position of the model railway and can easily guide a motor-driven vehicle onto the track by starting it on the rerailer.

FIGS. 10A to 10D show a still further embodiment of the rerailer in accordance with the present invention. In this embodiment, the rerailer is of the type which is placed on the rails and corresponds to a modification of a combination of the embodiments of FIGS. 5C and 5D. In the embodiment shown, conductive inclined base pieces 61*a* and 61*b*, which are made of a white metal or the like in a form symmetrical with each other, are coupled by an insulating holder 62 made of a plastic or the like in I-shaped sectional form. A clearance 63 is provided between the inclined base pieces 61*a* and 61*b*. The inclined base pieces 61*a* and 61*b* have respective outer guide walls 64*a* and 64*b* extending over their entire length and protruding inwardly adjacent to their lower end. The pieces 61*a* and 61*b* also have inner guide walls 65*a* and 65*b* which protrude outwardly opposite to the protrusions of the outer guide walls 64*a* and 64*b*. The outer wall 64*a* and the inner wall 65*a* are formed integrally with the inclined base piece 61*a*, while the outer wall 64*b* and the inner wall 65*b* are integrated with the piece 61*b*. On the bottoms of the inclined base pieces 61*a* and 61*b* are provided recesses 66*a* and 66*b* for fitting with the rails at several positions in an easy and reliable manner. The central insulating holder 62 and the outer guide walls 64*a*, 64*b* define therebetween wheel guide rails 67*a* and 67*b* so as to guide the wheels of a power-driven vehicle via the protrusions of the inner and outer walls onto the rails.

In the embodiment shown in FIGS. 10A to 10D, inclined base pieces 61*a*, 61*b* are integrally formed of a white metal or the like and can very easily be combined by use of the insulating holder 62 obtained by plastic molding. The rerailer thus made exhibits a good outer appearance and is suitable for practical use.

The above-described embodiments can be applied to the rails of any type regardless of the rail width.

Figure 11:
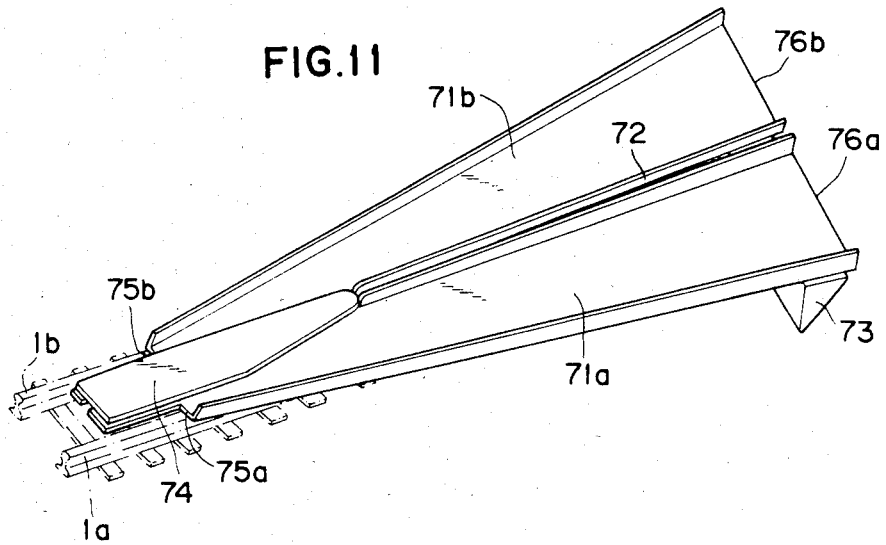
FIG. 11 is a perspective view showing a further embodiment of the electric rerailer in accordance with the present invention.

FIG. 11 shows an even further embodiment of the rerailer in accordance with the present invention, which is particularly suitable for wide rails generally called O-gauge rails. In FIG. 11, two conductive rails 71*a* and 71*b* for wheels are spaced apart from each other, and fixed on an insulating base 73 at the rear ends and on an insulating holder 74 at the front ends. The rails 71*a* and 71*b* are electrically contacted with the rails 1*a* and 1*b* at the front ends 75*a* and 75*b*, respectively. However, it is also possible to extend the rear ends 76*a* and 76*b* over the back of the insulating base 73 as far as the rails.

Obviously, numerous modifications and variations of the present invention are possible in view of the above teachings. It is therefore to be understood that within the scope of appended claims the invention may be practiced otherwise than as specifically described herein.

What is claimed is

1. A rerailer adapted to allow a model motor-driven vehicle having an electric motor which is provided electric power via a pair of electrically-conductive wheels to become properly disposed on a pair of spaced-apart electrically-conductive rails so that a large diameter section of each wheel is adjacent an inner side of a respective one of the rails, the rerailer comprising:

(a) a rerailer base;

(b) a first conductor disposed on said rerailer base and having a first end and a second end, said first conductor having a flat electrically-conductive upper surface with a width tapering from said second end to said first end, said first end of said first conductor disposed adjacent to and in electrical contact with a first one of said pair of rails;

(c) a second conductor disposed on said rerailer base and having a first end and a second end, said second conductor having a flat electrically-conductive upper surface with a width tapering from said second end to said first end, said first end of said second conductor disposed adjacent to and in electrical contact with a second one of said pair of rails;

(d) insulating means disposed on said rerailer base and disposed between said first conductor and said second conductor for electrically insulating said first conductor from said second conductor; and (f) guide means disposed on said rerailer base and disposed along said upper surface of said first conductor for guiding a first wheel of said pair of wheels along said upper surface of said first conductor and onto one of the pair of rails, and disposed along the upper surface of said second conductor for guiding a second wheel of said pair of wheels along the upper surface of said second conductor and onto the other of the pair of rails as the vehicle powered by the electric motor moves from said second ends to said first ends of said first and second conductors.

2. The rerailer as defined in claim 1, wherein said rerailer base is provided with an inclined surface having an upper end corresponding to said second ends of said first and second conductors, and is capable of being releasably mounted onto the pair of rails, and wherein said first conductor, said second conductor, and said guide means are disposed on said inclined surface.

3. The rerailer as defined in claim 1, wherein said rerailer base defines a plane substantially parallel to the pair of rails and is capable of being releasably mounted onto the pair of rails, and wherein said first conductor, said second conductor, and said guide means are disposed on said horizontal plane.

4. The rerailer as defined in claim 1, wherein said rerailer base defines a plane defined by ends of the pair of rails and is connectable between the ends of the pair of rails, and wherein said first conductor, said second conductor, and said guide means are disposed on said plane, and said first conductor and said second conductor are electrically connected to respective ends of the pair of rails.

5. The rerailer as defined in claim 1, wherein said guide means is positioned between said first conductor and said second conductor on said rerailer base.

6. The rerailer as defined in claim 1, wherein said guide means is positioned along the outer edge of said upper surface of said first conductor and along the outer edge of said upper surface of said second conductor.

7. The rerailer as defined in claim 1, further comprising positioning means formed in said rerailer base for allowing said rerailer base to be properly disposed on the pair of rails.

8. The rerailer means as defined in claim 1, wherein said insulating means and said guide means form a single physical structure.

* * * * *